US006044837A

United States Patent [19]

Tyler

[11] Patent Number: 6,044,837

[45] Date of Patent: Apr. 4, 2000

[54] INTERTWINED HELICAL HEAT EXCHANGER

[76] Inventor: Harry Arthur Tyler, 25851 Gooseneck Rd., Royal Oak, Md. 21662

[21] Appl. No.: 09/076,685

[22] Filed: May 12, 1998

[51] Int. Cl.[7] ..... F24H 3/00

[52] U.S. Cl. ..... 126/99 C; 126/99 A; 126/109; 126/116 R; 122/250 R; 122/DIG. 2; 165/163; 432/223

[58] Field of Search ..... 126/99 C, 99 R, 126/99 A, 99 D, 109, 110 R, 116 R, 6, 67, 72; 432/223; 122/367.1, 367.2, 367.3, 250 R, 249, DIG. 1, DIG. 2, 356, 13.1, 14; 165/163

[56] References Cited

U.S. PATENT DOCUMENTS

| | | | |
|---|---|---|---|
| 9,969 | 8/1853 | Gore | 126/99 C |
| 544,152 | 8/1895 | Benjumea | 126/99 C |
| 764,191 | 7/1904 | Hoesman | 126/109 |
| 983,566 | 2/1911 | Preuss | 126/99 C |
| 1,377,890 | 5/1921 | Kelso | 126/110 R |
| 1,561,161 | 11/1925 | Ionides, Jr. | 126/99 C |
| 1,674,213 | 6/1928 | McDowell | 126/110 R |
| 2,617,405 | 11/1952 | Keller | 126/109 |
| 2,790,435 | 4/1957 | Johnson | 126/109 |
| 3,245,395 | 4/1966 | Golibrzuch | 126/109 |
| 3,642,061 | 2/1972 | Waeselynck | 165/111 |
| 3,965,885 | 6/1976 | Von Wiesenthal | 126/110 AA |
| 4,230,090 | 10/1980 | Darnell | 126/72 |
| 4,589,374 | 5/1986 | Farina | 122/250 R |
| 4,958,619 | 9/1990 | Kardas | 126/85 R |
| 5,065,736 | 11/1991 | Mutchler | 128/110 B |
| 5,131,351 | 7/1992 | Farina | 122/250 R |
| 5,572,885 | 11/1996 | Erickson | 165/163 |

*Primary Examiner*—Ira S. Lazarus
*Assistant Examiner*—Josiah C. Cocks
*Attorney, Agent, or Firm*—Gene Scott-Patent Law & Venture Group

[57] ABSTRACT

A combustion and heating chamber into which a fluid is pumped under pressure is provided. A burner is positioned in the combustion and heating chamber to provide a heat load to the pressurized fluid in the chamber. As the fluid is heated its internal pressure is greatly raised providing a force for driving the heated air through a spiral conduit that encircles the combustion and heating chamber. An insulated outer wall is fitted around the spiral conduit and in contact with it. The individual wraps of the spiral conduit do not lay side by side, but are spaced apart. Relatively cool process air is drawn into the spaces between the separate wraps of the spiral conduit, which is thereby formed as a second spiral space intertwined with the spiral conduit between the combustion and heating chamber wall and the outer wall. The process fluid is therefore in contact with the walls of the spiral conduit. Preferably, as the heated fluid spirals in a downward direction under pressure and cooling as it moves downwardly, its heat is transferred through the walls of the spiral conduit into the space between the individual coils of the spiral conduit so as to heat the relatively cooler process air which is spiraling upwardly at the same time and being heated as it moves.

7 Claims, 3 Drawing Sheets

INTERTWINED HELICAL HEAT EXCHANGER

This application claims priority of the filing date of May 13, 1997 which is the date on which a Provisional application, Ser. No. 60/046,367 was filed, said provisional describing the present invention in detail.

BACKGROUND OF THE INVENTION

1. Field of the Invention

This invention relates generally to heat exchange equipment, and more particularly to a heat exchanger for heating process gases in an intertwined dual helical, annular conduit surrounding a burner fired air chamber.

2. Comment Concerning the Related Art

Heat exchangers are well known in the art. The most common are for thermal exchange between gaseous and liquid fluids such as air and water. For example, residential forced-air and hot water heating units generally heat air with a burner, the hot air rising through heating coils which are within the air flow or water flow path of the working fluid, i.e., air or water. In a nuclear power generator, the heat exchanger is a pipe carrying the working fluid, whereby the pipe is directed through the reactor core so as to transfer heat to the working fluid through the pipe's wall. In a solar energy heating system, the heat exchanger, is again, a coiled pipe residing in a hot water tank. Water cooling is provided in automobiles by passing ambient air through a grill-work attached to a radiator storage tank through which an engine cooling fluid is circulated.

The prior art teaches the use of heat exchangers for conducting heat from one fluid to another. The present invention is such an apparatus. However, the prior art does not teach that heat may be transferred by placing two intertwined helical flow paths around a combustion and heating chamber 30 and by driving the two fluids in counter flow directions. The present invention fulfills these needs and provides further related advantages as described in the following summary.

SUMMARY OF THE INVENTION

The present invention teaches certain benefits in construction and use which give rise to the objectives described below.

The present invention provides a primary combustion and heating chamber into which a gaseous fluid is pumped under pressure and in which the fluid is heated by the flame from an integral nozzle mixing burner. The outer surface of the heating chamber provides primary heat transfer to a process fluid through conduction to a spiral conduit and through radiation in the space formed between the wraps of the conduit. Secondary heat transfer is accomplished as the heated fluid moves through the spiral conduit. The individual wraps or turns, of the spiral conduit, lay between the inner heating chamber and an outer insulated cylindrical wall.

As the fluid is heated, its internal pressure is greatly raised providing a force for driving the fluid through the spiral conduit that encircles the heating chamber. An insulated outer wall is fitted around the spiral conduit and is in contact with it. The individual wraps of the spiral conduit do not lay side by side, but are spaced apart. Relatively cool process air is drawn into the space between the spiral conduit, which itself is formed as a second spiral intertwined with the spiral conduit between the heating chamber wall and the outer wall. The process air is therefore in contact with the walls of the spiral conduit. Preferably, as the heated air spirals in a downward direction under pressure and cooling as it moves downwardly, its heat is transferred through the walls of the spiral conduit into the space between the individual coils of the spiral conduit so as to heat the relatively cool process air which is spiraling upwardly at the same time and being heated as it moves. Since the process fluid is constantly being turned as it moves, efficient convective heat transfer occurs.

A primary objective of the present invention is to provide a heat exchanger for heating process air, having advantages not taught by the prior art.

Another objective is provide such an exchanger that is inexpensive to fabricate and yet provides superior operating characteristics.

A further objective is to provide such an exchanger having dual spiral paths for both the heating and the heated air flows in counter flow proximity so as to achieve efficient thermal transfer.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
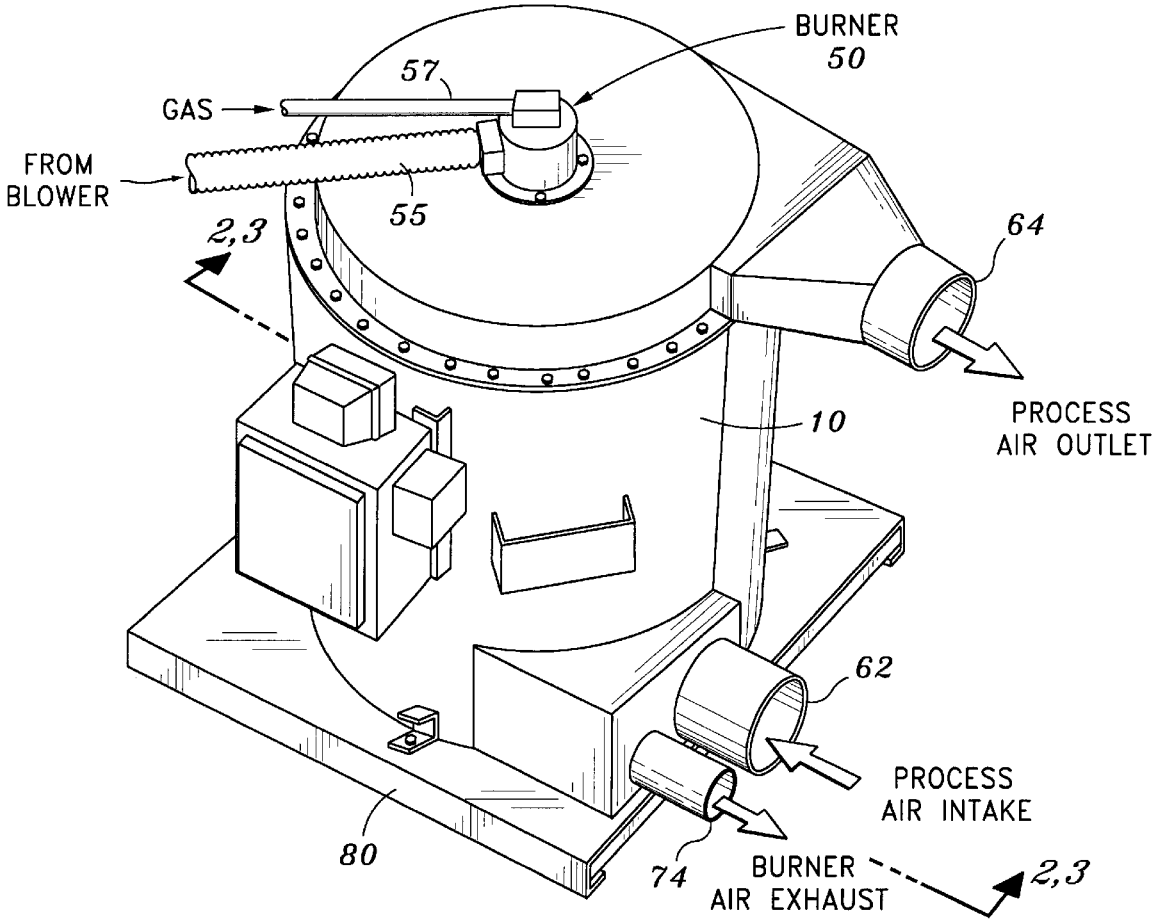
FIG. 1 is a perspective view of the preferred embodiment of the present invention apparatus.
Figure 2:
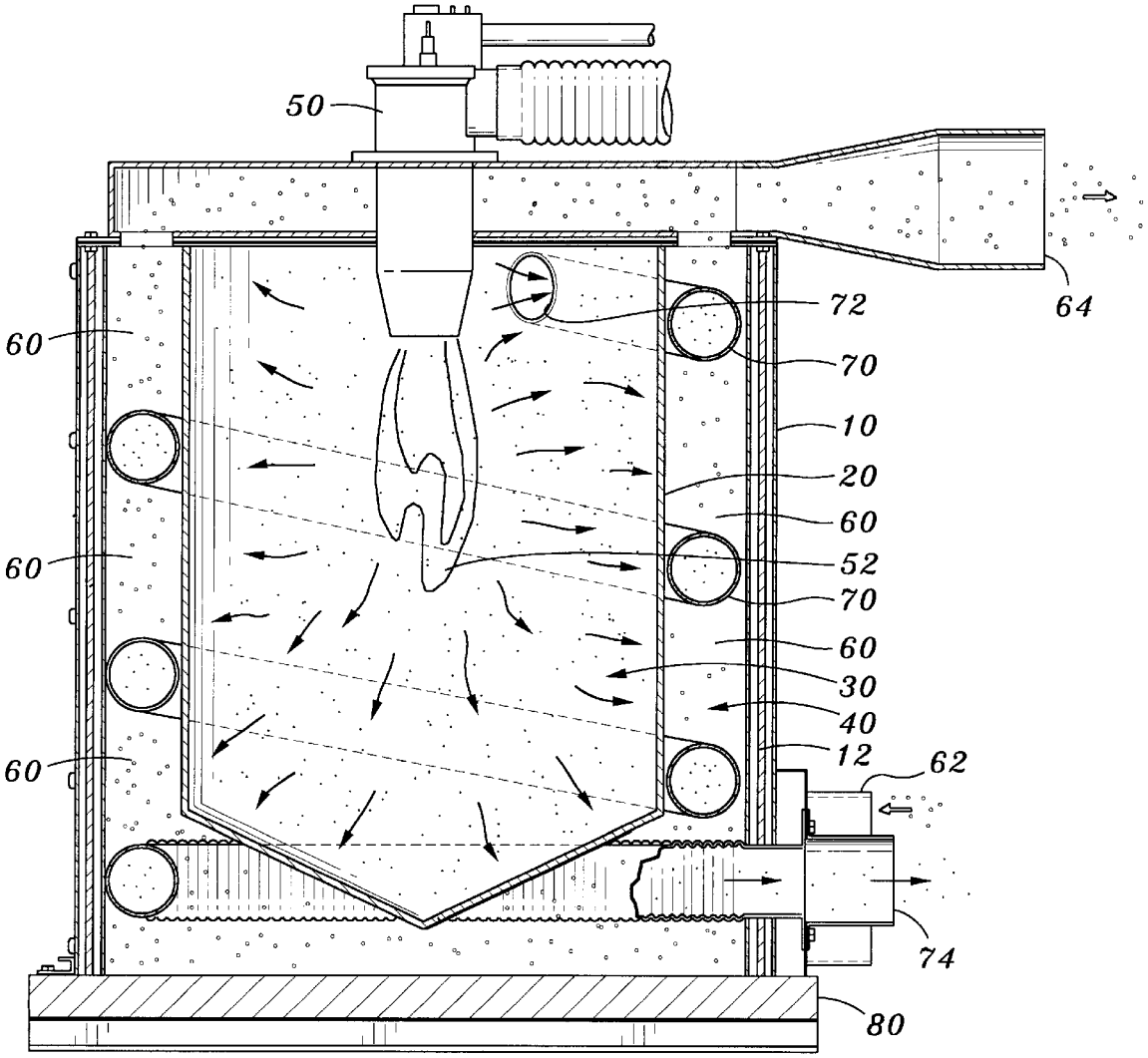
FIG. 2 is a vertical sectional view thereof taken along line 2—2 in FIG. 1 and showing, by arrows, a heat dispersion in a heating fluid within a heating chamber of the apparatus.
Figure 3:
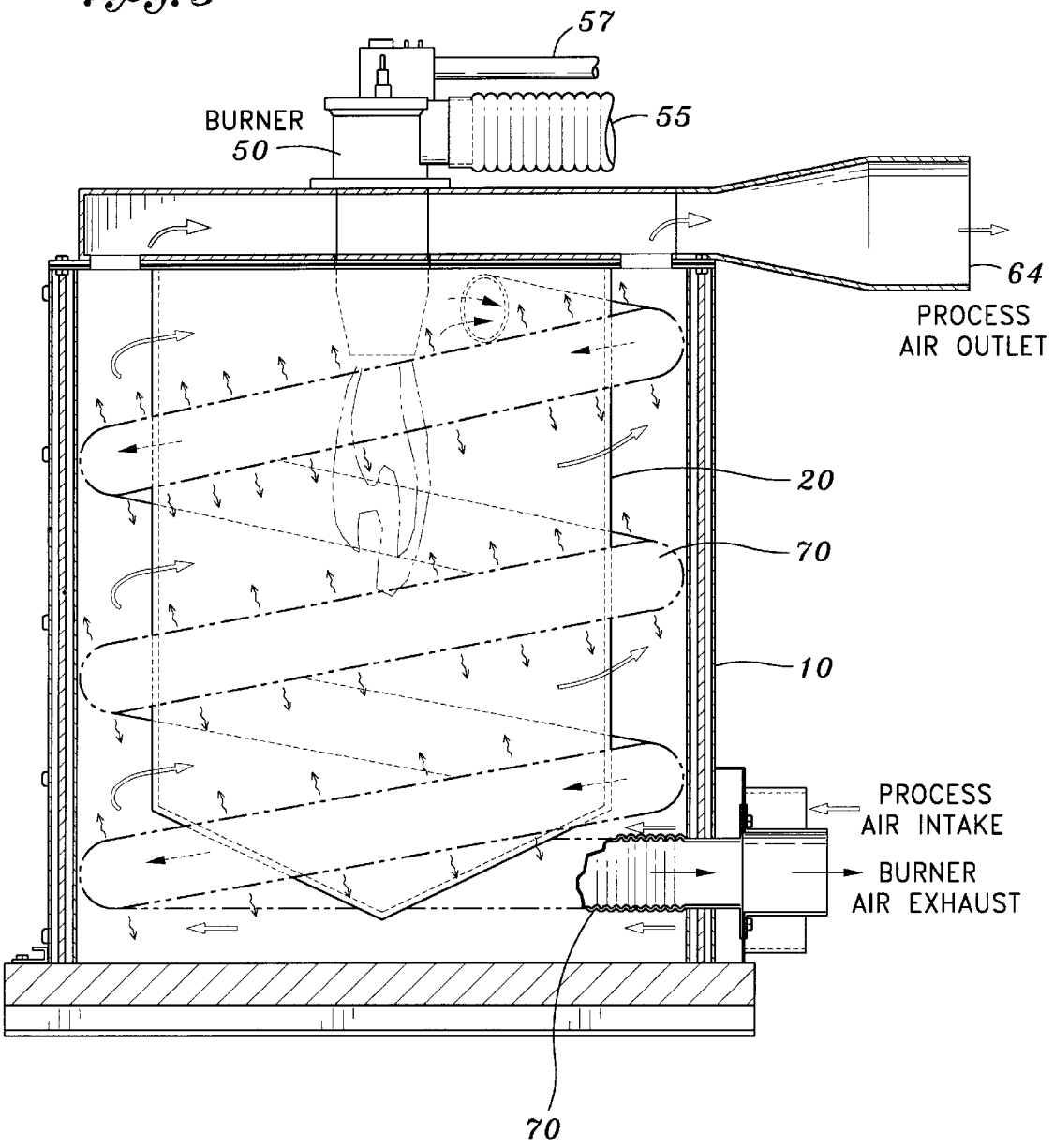
FIG. 3 is a vertical sectional view similar to that of FIG. 2 showing fluid flow within the apparatus, whereby a solid arrow shows the direction of flow of the heating fluid, while an open arrow shows the direction of flow of a process fluid, and a smaller undulating arrows shows the direction of heat transfer.

The above described drawing figures illustrate the invention, a heat exchanger apparatus, shown most clearly in FIG. 1, comprising an outer cylindrical chamber wall 10 enclosing a coaxially positioned inner cylindrical chamber wall 20 (FIGS. 2, 3) defining a combustion and heating chamber 30 within the inner cylindrical chamber wall 20. The outer and inner cylindrical chamber walls 10, 20 are preferably circular in cross-section, defining an annular space 40 therebetween. The inner chamber wall 20 must be made of a structural material with relatively good thermal transfer capability and must be able to withstand high heat exposure without degradation, such as stainless steel. The outer chamber wall 10 must be made of a structural material but should not easily transfer heat. In the preferred embodiment, as shown in FIGS. 1 and 2, a burner 50 is positioned for throwing a flame 52 axially within the combustion and heating chamber 30 for raising the temperature of a heating fluid therewithin. The heating fluid, usually air, is forced into the burner 50 and then the combustion and heating chamber 30 by a combustion blower (not shown) through inlet 55, while a fuel, preferably natural gas or fuel oil is forced into the burner 50 through pipe 57. In alternate embodiments other types of heating devices might be used, and of course, when the heating fluid is a liquid, a flame cannot be used. However, in the preferred embodiment, the heating fluid is preferably air. A tubular conduit 70, preferably of corrugated, flexible high grade stainless steel is wound as a spiral about the inner cylindrical chamber wall 20, the tubular conduit 70 being of such diameter as to partition the annular space 40 between the inner 20 and the outer 10 cylindrical chamber walls to form a continuous helical space 60 between the individual coils or wraps of the tubular conduit 70. The tubular conduit 70 is preferably of the very high corrugation type such that its surface area is at least 4 times that of a straight pipe of corresponding size and throughput capacity, and it provides a conduit inlet aperture 72 joining the tubular conduit 70 with the combustion and heating chamber 30 adjacent the burner 50 for drawing the heating fluid from the combustion and heating chamber 30 into the tubular conduit 70. This hot fluid is referred to as the heating fluid since its purpose is to provide heat to the working or process fluid. The heating fluid and the process fluid are not mixed. An outlet aperture 74 is positioned at the outer cylindrical wall 10 distally from the burner 50 for expending the heating fluid from the tubular conduit 70. A process fluid inlet 62 is preferably positioned distally from the burner 50 for drawing the process fluid into the helical space 60 between the inner 20 and outer 10 cylindrical walls, and a process fluid outlet 64 is positioned adjacent to the burner 50 for expending the process fluid from the helical space 60 so that it may be used in a commercial or industrial process or other processes requiring a hot fluid. Heat energy is transferred from the heating fluid to the process fluid, preferably both streams of gases, through the walls of the tubular conduit 70 and also through the inner cylindrical wall 20. Because the construction is cylindrical and circular, thinner materials can be employed and higher differential pressures may be withstood. Additionally, light weight and low cost result from such construction. Series flow paths assure high efficiency and low fuel cost. The use of a flexible corrugated annular spiral tube assures simple assembly and low materials cost. The design provides for scaling to virtually any size. Typically, process air up to 20 PSIG and flow rates up to 6,000 SCFM can be heated to 1000 degrees Fahrenheit Thermal efficiency may be as high as 90% with the present invention. Efficient combustion minimizes emissions and assures low flue outlet temperature. The round construction minimizes floor space.

Preferably, the burner is a forced-draft, nozzle mixing, high velocity fuel gas burner, oriented for directing the flame downwardly, but may be positioned in other appropriate attitudes and may consist of more than one burner or heating unit. Preferably, the outer cylindrical chamber wall 10 provides a means for thermal insulation 12 such as any common insular material as is in common use in high temperature industrial apparatus. Examples of common insulating materials are glass wool, clay and ceramic tiles. Preferably, the apparatus is mounted upon a base 80 which may be considered an integral portion of the structure of the apparatus and is important for assuring thermal isolation from ground. To this point, the base 80 should be made of a stable material and provide heat rejection as well. Such materials and constructions are well known in the art for furnace supports. The present invention further preferably includes a means for forcing the heating fluid under pressure into the combustion and heating chamber 30, such as a high speed combustion air blower or fluid pump (not shown).

In a broader sense the present inventive apparatus is a heat exchanger which may be described as comprising a pair of concentric cylindrical walls 10 and 20 enclosing an annular space 40 therebetween, and including fluid heating means 50 positioned axially within the cylindrical walls for producing a heating fluid flow, a first means for directing 70 the heating fluid flow, in a first spiral path within the annular space 40, and a second means for directing 60 a cooler process fluid flow in a second spiral path, intertwined with the first spiral path in a direction counter to the heating fluid flow within the annular space 40 so as to transfer heat from the heating fluid to the process fluid.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A heat exchanger apparatus comprising:

an outer cylindrical chamber wall enclosing a coaxially positioned inner cylindrical chamber wall defining a combustion and heating chamber, the outer and inner cylindrical chamber walls defining an annular space therebetween;

a burner positioned for throwing a flame axially within the combustion and heating chamber for raising the temperature of a heating fluid therewithin;

a tubular conduit wound as a spiral about the inner cylindrical chamber wall, the tubular conduit being of such diameter as to partition the annular space between the inner and the outer cylindrical chamber walls to form a continuous helical space therein;

the tubular conduit providing a conduit inlet aperture joining the tubular conduit with the inner chamber adjacent the burner, for drawing the heating fluid from the combustion and heating chamber into the tubular conduit, and firther providing a conduit outlet aperture positioned at the outer cylindrical wall distally from the burner for expending the heating fluid from the tubular conduit;

a process fluid inlet positioned distally from the burner for drawing a process fluid into the helical space between the inner and outer cylindrical walls; and a process fluid outlet positioned adjacent to the burner for expending the process fluid from the helical space.

2. The apparatus of claim 1 wherein the burner is oriented for directing the flame downwardly.

3. The apparatus of claim 1 wherein the outer cylindrical chamber wall provides a means for thermal insulation.

4. The apparatus of claim 3 further comprising a base for supporting the apparatus thereupon.

5. The apparatus of claim 1 wherein the inner and outer cylindrical walls are circular in cross-section.

6. The apparatus of claim 1 wherein the tubular conduit is constructed with a corrugated wall capable of conforming to the inner cylindrical chamber wall.

7. The apparatus of claim 6 wherein the corrugated wall is of such shape as to provide a surface area of at least four times that of a corresponding straight wall tubular conduit.

* * * * *